US005971205A

United States Patent [19]

Michaels et al.

[11] Patent Number: 5,971,205

[45] Date of Patent: Oct. 26, 1999

[54] CIGAR VENDING MACHINE

[76] Inventors: Peter T. Michaels; Joseph R. Preston, both of 7801 Norfolk Ave., Bethesda, Md. 20852

[21] Appl. No.: 08/815,857

[22] Filed: Mar. 12, 1997

[51] Int. Cl.[6] ..... G07F 11/72

[52] U.S. Cl. ..... 221/135; 221/92; 221/150 A; 221/241

[58] Field of Search ..... 221/92, 131, 135, 221/150 R, 150 A, 241, 278; 901/40

[56] References Cited

U.S. PATENT DOCUMENTS

| | | | |
|---|---|---|---|
| D. 110,497 | 7/1938 | Rich . | |
| D. 116,820 | 9/1939 | Garner et al. . | |
| D. 256,376 | 8/1980 | MacKrell . | |
| D. 293,608 | 1/1988 | Fitzgerald et al. . | |
| 530,561 | 12/1894 | Thissell | 221/131 X |
| 682,792 | 9/1901 | Doremus | 221/135 X |
| 1,280,298 | 10/1918 | Ravert | 221/135 X |
| 1,450,058 | 3/1923 | Allen | 221/241 |
| 2,311,632 | 2/1943 | Berger et al. | 221/241 |
| 2,382,350 | 8/1945 | Testi . | |
| 3,406,743 | 10/1968 | Gomez | 165/229 |
| 3,674,175 | 7/1972 | Jaquish | 221/92 |
| 4,008,930 | 2/1977 | Swainson . | |
| 4,478,353 | 10/1984 | Levasseur . | |
| 4,598,378 | 7/1986 | Giacomo . | |
| 4,706,842 | 11/1987 | Guadagnino . | |
| 4,721,197 | 1/1988 | Hoffman | 221/92 X |
| 4,860,876 | 8/1989 | Moore et al. . | |
| 5,027,698 | 7/1991 | Chirnomas . | |
| 5,044,520 | 9/1991 | Moisan | 222/2 |
| 5,065,897 | 11/1991 | Smith | 221/130 |
| 5,207,784 | 5/1993 | Schwartzendruber . | |
| 5,240,139 | 8/1993 | Chirnomas . | |
| 5,245,150 | 9/1993 | Grandi . | |
| 5,351,856 | 10/1994 | Laidlaw . | |
| 5,450,980 | 9/1995 | Laidlaw . | |
| 5,842,597 | 12/1998 | Kraus et al. | 221/150 R |

FOREIGN PATENT DOCUMENTS

| | | | |
|---|---|---|---|
| 705749 | 3/1965 | Canada | 221/92 |
| 2142318 | 1/1985 | United Kingdom . | |
| 2192180 | 1/1988 | United Kingdom . | |

OTHER PUBLICATIONS

Fastcorp Brochure (no date given), For "F–631 Frozen Merchandiser" Ice Cream Vending Machine & Robotic Dispenser.

1997 Vigilant Humidor Product Catalog, p. 11, "Guardian 20" and "Guardian 70" Humidifiers.

*Primary Examiner*—James W. Keenan
*Attorney, Agent, or Firm*—Richard C. Litman

[57] ABSTRACT

A cigar vending machine provides for the automated vending of cigars which are stored in a humidor area within the machine until being dispensed. The humidor portion of the machine provides for the automatic control of the humidity and at least the minimum temperature therein, to maintain the freshness of the cigars stored therein until they are purchased. The machine may utilize conventional automated currency and credit card acceptance devices, and also utilizes a robotic arm dispensing device which withdraws a given cigar from an appropriate storage area within the humidor, depending upon the selection made by the purchaser. The separate storage areas may be adjusted in size to accommodate different sizes, types, and/or brands of cigars, as desired. The machine operates by accepting an appropriate currency or credit card input by a purchaser, who then makes a selection on a cigar selection panel on the front of the machine. When the selection has been made, the machine automatically opens the lid to the humidor, and the robotic arm travels to a position above the compartment in which cigars of the selected type are stored. The arm withdraws the uppermost one of the selected cigar type, and transfers the selected cigar to a dispensing tray in the front of the machine, which is accessible by the purchaser. The present machine enables cigar smokers to purchase a cigar as desired at any time, without need to visit a tobacco shop or the like during its hours of operation.

18 Claims, 7 Drawing Sheets

42

CIGAR VENDING MACHINE

BACKGROUND OF THE INVENTION

1. Field of the Invention

The present invention relates generally to automated, self service vending machines, and more specifically to a machine which provides an optimum temperature and humidity controlled environment for the storage of cigars. The machine dispenses cigars singly, but provides for the purchase of multiple cigars through an automated currency acceptor and/or bank card reader. Cigars are stored in vertically disposed stacks within the humidor portion of the machine, which provides for the separate storage of several different brands and/or types of cigars. The cigars are handled by an arm which picks up cigars singly from the desired stack, and conveys them to a dispenser. The present machine assures purchasers that the smoking materials purchased therefrom, are of the highest quality due to the controlled storage environment.

2. Description of the Related Art

Vending machines for various articles, including tobacco products such as cigarettes, have been known for quite some time. However, cigarettes have been determined to be hazardous to the health of the smoker, and accordingly restrictions on the sale and use of cigarettes have been enacted throughout the country. This includes the location and environment of cigarette vending machines.

Accordingly, many smokers have turned to other types of tobacco products, which are not so heavily restricted. In the past, cigar sales have been relatively low in comparison to cigarettes, but with the restrictions placed upon cigarette sales and usage, cigars are enjoying an increase in sales. While the smoking of cigars is still restricted in many areas, they are not subject to the sales restrictions imposed upon cigarettes by the Food and Drug Administration.

Thus, the machine vending of cigars is permissible in many areas, unlike the situation with cigarettes. Nevertheless, the machine vending of cigars has never been developed, as cigars are relatively fragile and must be maintained in a closely controlled environment insofar as their temperature and particularly their humidity is concerned. Heretofore, this has not been possible in a vending machine, and the quality of cigars stored within a vending machine would suffer accordingly. Cigar smokers have been forced to visit a tobacco shop or other store selling cigars, which stores are of course not open at all hours of every day. Indeed, stores selling cigars, particularly a specific type or brand of cigar, may be few and far between, forcing the smoker to spend a relatively large amount of time in seeking out his desired cigar.

Accordingly, a need will be seen for a cigar vending machine, which stores cigars therewithin in a closely controlled environment of temperature and humidity. A discussion of the prior art known to the inventors, and its distinctions from the present invention, is provided below.

U.S. Pat. No. 2,382,350 issued on Aug. 14, 1945 to Nicholas Testi describes a Cigarette Dispenser, comprising a cylindrical housing holding a plurality of cigarettes. Humidifying means is disclosed, but no mechanized control of the humidity is provided, and no temperature control is provided. The device is intended to be a household article, and as such, no provision is made for accepting currency in the Testi dispenser. Moreover, the cigarettes stored therein are stored in a single compartment, and thus cannot be separated by type and brand, as provided for cigars in the multiple compartments of the present vending machine.

U.S. Pat. No. 4,008,930 issued on Feb. 22, 1977 to Ralph V. Swainson describes a Humidor comprising a conventional bucket-shaped container with a lid which may be sealed to the upper edge of the container. The lid includes a water reservoir and spray nozzle, activated by depressing a flexible dome in the lid. The device is not so much a humidifier as a moisturizer, as the water spray is in liquid rather than vapor form. In any event, the device is not automatically operated and cannot control the humidity or temperature within a closely controlled range, as provided by the present machine. No automated dispensing is disclosed, nor is any means provided for the collection of money from a purchaser nor for the separation of different types or brands of articles within the container, all of which features are provided by the present cigar vending machine.

U.S. Pat. No. 4,478,353 issued on Oct. 23, 1984 to Joseph L. Levasseur describes a Vendor Control System, comprising an electromechanical circuit for accepting money from a purchaser and vending the selected product. Levasseur is silent regarding the incorporation of temperature and humidity controls with any machine with which his system is used, or the electromechanical conveyance system used with the present machine to convey the cigar(s) to a purchaser.

U.S. Pat. No. 4,598,378 issued on Jul. 1, 1986 to Harlan R. Giacomo describes a Management Information System And Associated Vending Control Device, comprising an electrical circuit providing much the same functions as the Levasseur circuit described immediately above. While Giacomo provides additional features and functions, the disclosure is silent regarding any provision for humidity and temperature control, mechanical vending means, or other operations provided by the present cigar vending machine.

U.S. Pat. No. 4,706,842 issued on Nov. 17, 1987 to Gus A. Guadagnino describes an Apparatus For Dispensing Elongated Cylindrical Objects Such As Pencils. The device includes a single moveable compartment therein, which is moved to a dispensing position to drop an article through a slot by actuating a coin acceptance slide. No multiple compartments for containing or dispensing different types or brands of articles is disclosed, nor is any means of controlling the temperature and humidity of the articles within the container, as provided by the present invention.

U.S. Pat. No. 4,860,876 issued on Aug. 29, 1989 to William A. Moore et al. describes an Article Vending Machine Employing Unique Robotic Arm And The Robotic Arms Employed Therein. The Moore et al. robotic system uses a circular drum containing the product to be vended (i. e., video cassettes), and is not operable in an orthogonal X-Y matrix of different products, as provided by the robotic dispensing system of the present machine. In any event, Moore et al. are silent regarding other details of the vending machine, particularly relating to temperature and humidity control, which are required in the present cigar vending machine.

U.S. Pat. No. 5,027,698 issued on Jul. 2, 1991 to Munroe Chirnomas describes an Ice Cream Vending Machine, including means for keeping frozen individual cups of ice cream therein, dispensing the cups individually, removing their lids, warming them, and placing selected toppings thereon. No humidity control of the contents of the machine is disclosed, and the dispensing system is not at all similar to that used in the present machine.

U.S. Pat. No. 5,207,784 issued on May 4, 1993 to Wilbur Schwartzendruber describes a Vending Machine With Monitoring System, wherein the system reports on the quantity of goods remaining in each of up to several machines. The machines also report at least one type of jam or blockage, with the system providing a signal to the machine(s) to unblock the blockage. No temperature or humidity control means is disclosed, and the disclosed dispensing system is not similar to that used with the present cigar vending machine.

U.S. Pat. No. 5,240,139 issued on Aug. 31, 1993 to Munroe Chirnomas describes a Package Vending Machine similar to the '698 patent to the same inventor discussed hereinabove. The '139 patent, however, discloses a thermally insulated freezer compartment with at least one lid or top embodiment similar to that used in the present invention, and a cable system for lifting the lid which is also similar to that used in the present invention. The Chirnomas '139 patent also describes the use of a vertical robotic arm operating on two orthogonal tracks, with the arm being positionable in an X-Y coordinate pattern over the freezer compartment to select a frozen article from any given area of the freezer. Although the cigar storage apparatus of the present invention employs a generally known X-Y coordinate positionable robotic arm, Chirnomas teaches away from the use of such device as a humidor to add moisture to the stored product. Such moisture addition is not desirable in an environment which is maintained below freezing, and would reduce the efficiency and operability of the device of the Chirnomas '139 patent. On the other hand, the addition of moisture to provide a predetermined level of humidity at a given temperature above freezing, is desirable in the storage of cigars to maintain their freshness, and is provided for in the present cigar dispensing machine.

U.S. Pat. No. 5,245,150 issued on Sep. 14, 1993 to Rene Grandi describes a Selective Reheating Device For Food Products, wherein one of a plurality of frozen food products may be remotely selected and manipulated into a movable heating area for cooking or heating. The product is dispensed when heating is completed. Grandi is silent regarding any currency acceptance means for automated purchase of the food products within the machine. No humidor means is disclosed by Grandi, as the Grandi device is not suited for use as a cigar storage and vending machine, as provided by the present machine.

U.S. Pat. No. 5,351,856 issued on Oct. 4, 1994 to Ronald W. Laidlaw describes a Vending Machine For Individual Cigarettes, containing a plurality of bins with loose cigarettes contained therein. A separate coin slot is provided for each bin, rather than a single currency acceptor and internal selection means for the different products contained within the machine. Laidlaw is silent regarding any means of keeping the cigarettes fresh, as provided by the humidifier means of the present cigar vending machine.

U.S. Pat. No. 5,450,980 issued on Sep. 19, 1995 to Ronald W. Laidlaw describes a Coin Operated Vending Machine For Vending Individual Cigarettes From A Cigarette Manufacturer's Container. The device of this patent is a variation upon the device of the '856 patent to the same inventor and, as discussed immediately above, has similar disadvantages.

U.S. Pat. No. D-110,497 issued on Jul. 12, 1938 to Philip Rich illustrates a design for a Vending Machine, comprising a tall rectilinear cabinet having selection controls in the front thereof, below a transparent front panel. No internal mechanism providing for temperature and humidity control, or the selective dispensing of products contained therein, is apparent in the Rich design.

U.S. Pat. No. D-116,820 issued on Sep. 26, 1939 to Lue O. Garner et al. illustrates a design for a Vending Machine, apparently including two separate coin boxes on one side thereof and a transparent panel in the front of the machine. A circular distribution device appears to be disposed within the cabinet. No internal mechanism providing for temperature and humidity control is apparent in the design, and the circular distribution device is unlike the mechanism used in the present machine.

U.S. Pat. No. D-256,376 issued on Aug. 12, 1980 to William B. MacKrell illustrates a design for a Beverage Dispensing Machine having an upper portion with an access and selection panel and a planar lower portion. No means for the maintenance of the internal temperature and humidity of the machine, or for the selective dispensing of cigars, is apparent.

U.S. Pat. No. D-293,608 issued on Jan. 5, 1988 to Walter G. Fitzgerald et al. illustrates a design for a Humidor comprising a generally cylindrical container. As in the other designs discussed above, no mechanism providing for the automated control of temperature and humidity, or for the selective dispensing of cigars, is apparent.

British Patent Publication No. 2,142,318 published on Jan. 16, 1985 to De La Rue Systems Ltd. describes Banknote Handling Machines, and more specifically a particular mechanism for manipulating currency within the machine or distributed from the machine. No relationship is seen to the present cigar vending machine, other than that the present machine may utilize certain automated components in its currency acceptance system.

British Patent Publication No. 2,192,180 published on Jan. 6, 1988 to the Coca-Cola Company describes a Beverage Can Vending Machine having a curved, translucent front panel which is intended to resemble a beverage can. No internal mechanism providing for control of temperature and humidity, or for the selective dispensing of articles therefrom, is disclosed.

In addition, a brochure from the Fastcorp company illustrates their F631 Frozen Merchandiser, a vending machine for ice cream products and the like. The machine utilizes a robotic pickup arm to lift the products from a freezer bin. While the robotic arm is generally similar in function to that used in the present invention, the machine disclosed does not provide any heating or humidifying means.

Finally, page eleven of the 1997 Vigilant Humidor Product Catalog, copyright 1996, discloses Guardian 20 and Guardian 70 humidifiers which may be suitable for use with the present cigar vending machine. No vending means, cigar storage means therewith, or auxiliary water supply or heating means is disclosed.

None of the above inventions and patents, taken either singly or in combination, is seen to describe the instant invention as claimed.

SUMMARY OF THE INVENTION

The present invention comprises a cigar vending machine having automated control of temperature and humidity within at least the cigar storage portion of the machine, and further separate storage of different types and brands of cigars and means for the selective dispensing of cigars from the machine. Conventional financial transaction mechanisms are used with the machine, for a purchaser to make an automated purchase of one or more cigars from the machine. The temperature and humidity controls assure that cigars stored within the machine remain fresh during their storage period.

Accordingly, it is a principal object of the invention to provide an improved cigar vending machine which includes at least humidifying means for a cigar humidor enclosed within the machine, and automated means for controlling the humidity and maintaining the humidity at a constant level.

It is another object of the invention to provide an improved cigar vending machine which includes automated heating to keep the temperature within the humidor at a constant minimum level.

It is a further object of the invention to provide an improved cigar vending machine which includes a plurality of bins within the humidor, with each of the bins being adjustable to provide for the storage of different sizes, types, and/or brands of cigars therein.

An additional object of the invention is to provide an improved cigar vending machine which may include an auxiliary supply of water for the humidifier portion of the machine, to preclude need for frequent replenishment of the water supply.

Still another object of the invention is to provide an improved cigar vending machine which includes at least currency transaction means and robotic cigar dispensing means therewith.

It is an object of the invention to provide improved elements and arrangements thereof in an apparatus for the purposes described which is inexpensive, dependable and fully effective in accomplishing its intended purposes.

These and other objects of the present invention will become apparent upon review of the following specification and drawings.

BRIEF DESCRIPTION OF THE DRAWINGS

Similar reference characters denote corresponding features consistently throughout the attached drawings.

DETAILED DESCRIPTION OF THE PREFERRED EMBODIMENTS

Figure 1:
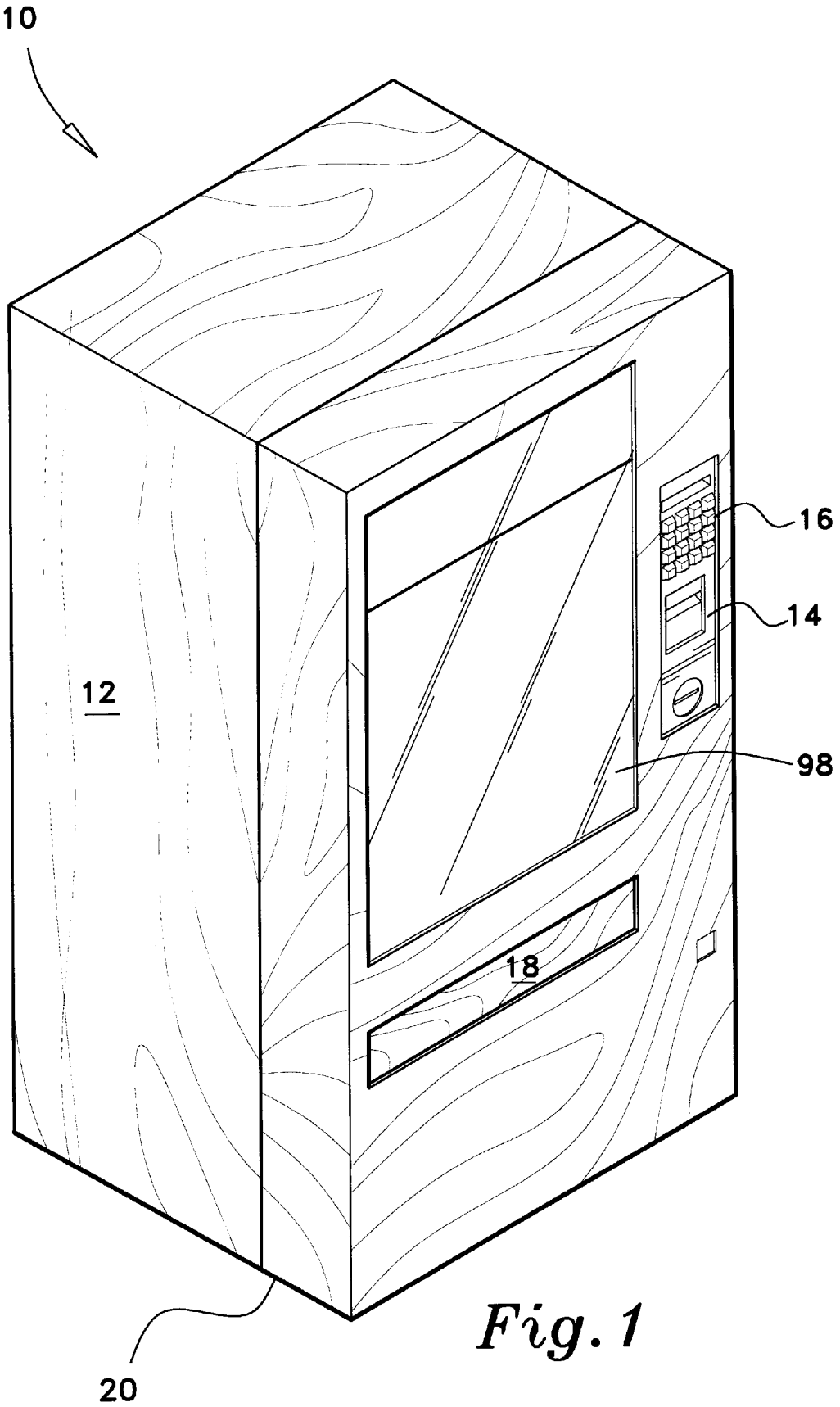
FIG. 1 is a front perspective view of the present cigar vending machine, showing the front panel and its general features.

The present invention comprises a cigar vending machine, indicated by the reference numeral 10 in FIG. 1. While various automatic vending machines for various products and services have been developed in the past, the present machine 10 also incorporates a humidor area, which stores cigars at a predetermined and automatically controlled level of humidity to maintain their freshness during their storage period before purchase. The generally rectangular housing 12 of the machine 10 also includes various conventional components, such as the automated currency or credit card acceptance device 14, article selection panel 16, and delivery door or panel 18 shown installed within the normally closed and locked front door panel 20, which is openable to provide access to the internal volume of the machine 10, shown in other drawing figures and discussed further below. The currency acceptance device 14 may comprise a Mars VFM1, VFM3, or Series 2000 bill validator and a TRC 6000 coin mechanism (or equivalents), as incorporated in the F631 Frozen Merchandiser manufactured by Fastcorp, and discussed hereinabove.

While the present machine 10 is particularly adapted for the storage and vending of cigars, it will be seen that it may be used for vending other articles requiring storage in an environment having closely controlled humidity, as well. While the specific storage means disclosed in the drawing figures is particularly adapted for the stacked horizontal storage of elongate articles in separate silos or bins, it will be seen that such a configuration may be modified for storage of differently shaped articles, so long as the humidifier means communicates with the article storage means in order to maintain the proper humidity within the storage area.

Figure 2:
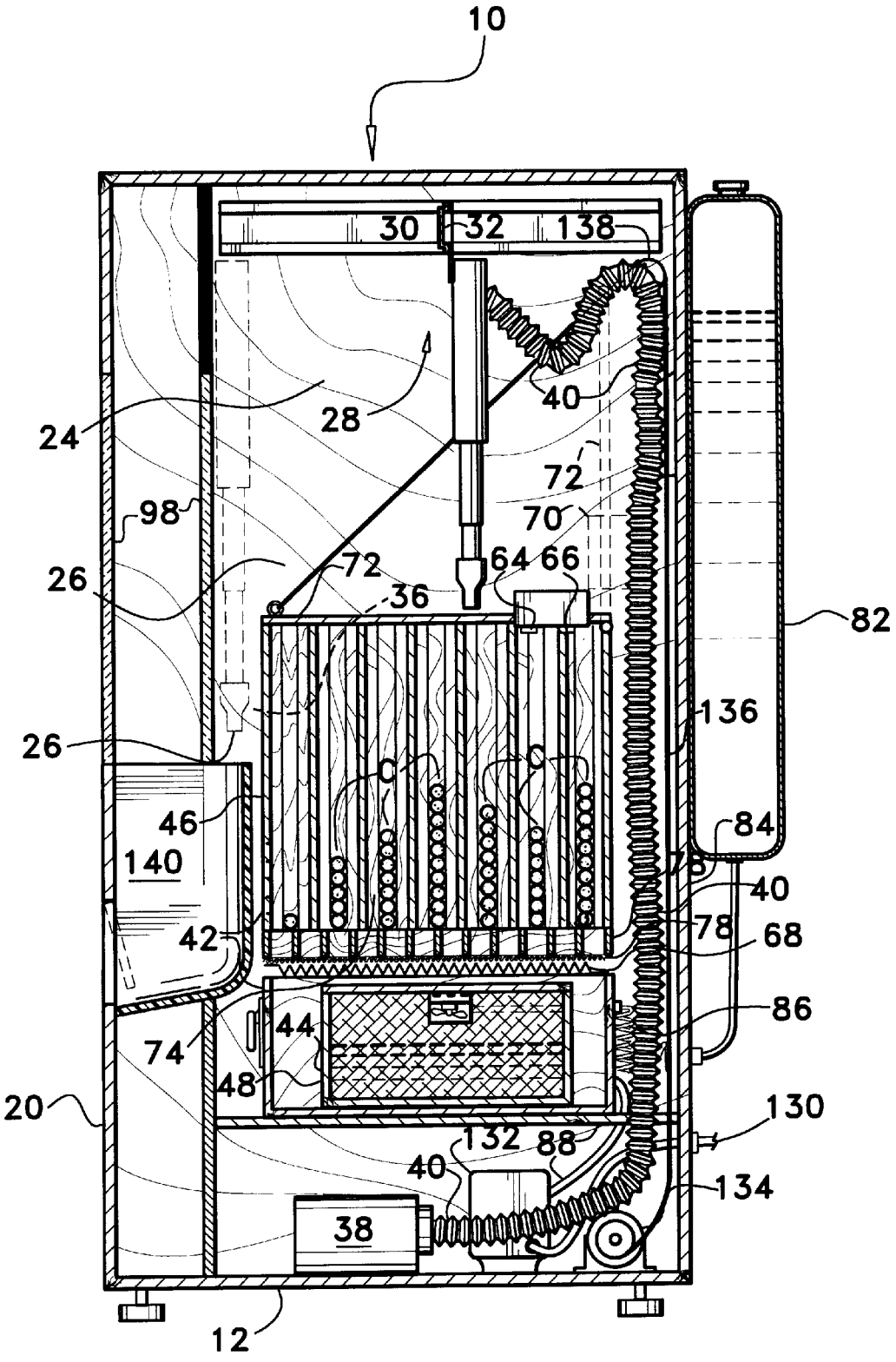
FIG. 2 is a right side elevation view in section of the cigar vending machine, showing various internal details thereof.

FIG. 2 provides a side elevational view in section of the present cigar vending machine 10. The interior or internal volume 22 generally comprises an upper or dispensing portion 24 and a lower or storage and humidifying portion 26. The upper portion 24 includes an automatic robotic cigar or article dispensing system 28, such as the apparatus disclosed in the Chirnomas U.S. Pat. No. 5,245,150 and incorporated in the Fastcorp F-631 Frozen Merchandiser. Other suitable alternative dispensing means may be incorporated in the present vending machine, as desired. Basically, the dispensing device 28 comprises a first and an opposite and parallel second fixed track 30 disposed within the upper portion 24 of the housing 12, with a movable track 32 extending between the first and second tracks 30 and orthogonal to the two fixed tracks 30. Only the first fixed track 30 is shown, due to the sectional nature of FIG. 2, but it will be understood that the second track is a mirror image of the first.

A telescoping, generally vertically disposed pickup arm 34 extends downwardly from the single movable track 32, with the pickup arm 34 having a vacuum operated lowermost tip 36 which is used to apply a vacuum selectively to one of the cigars C or other article stored in the lower portion 26 of the interior 22 of the machine 10. Vacuum is supplied as required from an electric motor and suction pump 38, which communicates with the depending arm 34 and lower tip 36 through a flexible vacuum hose 40.

Figure 3:
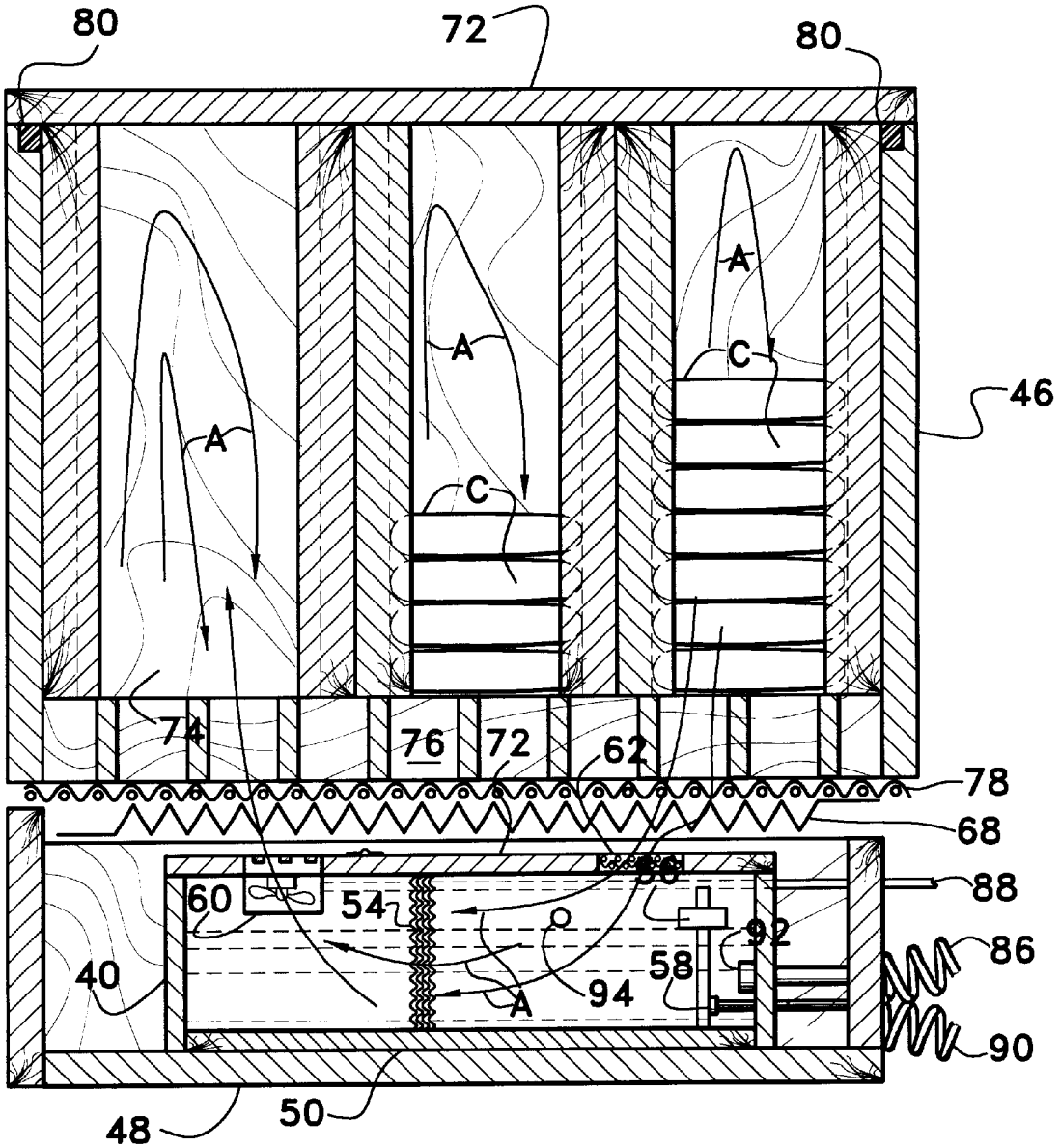
FIG. 3 is a front elevation view in section of the humidor portion of the present machine, showing various details thereof.

The lower or cigar storage and humidifying portion 26 of the present vending machine 10 includes a cigar or article humidor apparatus therein, generally indicated by the reference numeral 42 and shown in detail in FIG. 3. The humidor 42 generally comprises two portions: The lowermost portion is an automated humidifying device 44, and the upper portion is a cigar or article storage container 46, disposed immediately above the humidifier 44.

The automatic humidifier 44 is contained in a slidably or otherwise removable drawer or receptacle 48, which is accessible for service or maintenance when the front door panel 20 of the machine 10 is opened. The humidifier unit 44 may be similar to the Guardian 20 or Guardian 70 humidifiers sold by the Vigilant, Inc. Company for use with cigar humidors, and includes a case 50 having an openable upper lid 52 for access to the humidifying wick 54, water level float 56, low water sensor 58, and/or any other components which might be contained therein. The upper part of the unit 44 includes a selectively operable fan motor 60, which serves to draw air through the wick 54 by means of one or more inlet(s) 62.

The humidifier 44 is actuated by a humidity sensor 64, which may be disposed within the cigar storage cabinet 46, as shown in FIG. 2 or in another suitable location. The specific location is not critical, so long as the humidity sensor (hygrometer, etc.) is situated so as to sense accurately the average humidity within the container or cabinet 46. The hygrometer 64 may be positioned with a thermostat 66, with the two instruments respectively providing actuation signals for the humidifier fan motor 60 and an optional heating element 68, which may be disposed immediately beneath the cabinet 46 as shown schematically in FIG. 3. The two sensors 64 and 66 may also provide a digital readout 70 or indication of the humidity and temperature within the cabinet 46 (conventional light emitting diode or liquid crystal display, etc.) disposed atop the cabinet 46, or the display may be positioned remotely from the sensors (e. g., in the front panel of the door 20, etc.).

It will be seen that the cigar storage cabinet 46 is closed about each of its sides and its normally closed but selectively openable top or lid 72, but has an open bottom 74 in order to communicate with the output of the humidifier 44, as indicated by the airflow arrows A in FIG. 3. The cigars C and racks therefor disposed within the cabinet 46 are supported by an open wooden grid 76, and/or an open plasticized metal rack or screen 78, as desired, to allow humid air to flow upwardly from the fan 60 and through the various areas of the cigar storage cabinet 46. The upper rim of the cabinet 46 includes a seal 80 therearound, to provide a good seal with the lid 72 when it is in its normally closed position.

It is anticipated that the present cigar vending machine 10 may be operated for relatively long periods of time, and/or in relatively warm and dry climates, without regular service. This is not a problem, so long as sufficient water is provided for the humidifier 44. Normally, the humidifier 44 operates from a self contained water supply W within the humidifier 44 itself; this is normally sufficient for the humidifier to operate for a period of several days. However, in warmer and/or dryer areas, it may be necessary to provide a relatively larger supplemental tank 82 secured externally to the rear wall 84 of the machine 10 as shown in FIG. 2, or to another suitable portion of the machine 10 (top, interior, etc.). This larger tank 82 is connected to the humidifier 44 by a flexible water line 86, which (along with the flexible electric power line 88 for the fan motor 60, and the flexible sensor line 90) allows the humidifier 44 to be pulled from the base of the machine 10 by means of the drawer 48 when the front door panel 20 is opened.

In normal use, it is expected that the addition of humidity to the cigar storage cabinet 46 by the humidifier 44, in addition to an auxiliary ventilation fan (not shown) which may be provided, will be sufficient to maintain the internal temperature of the humidor 42 at around seventy degrees Fahrenheit, even when the ambient temperature is up to twenty degrees warmer, due to the latent cooling effect of evaporation. However, an optional refrigerated air conditioning system (not shown) may be added, if desired, in order to handle extreme conditions of heat and high humidity.

The water level of the humidifier portion 44 is controlled by a float mechanism 56, indicated generally in FIG. 3. The float may be column mounted, as shown, or pivotally mounted, as often found in a toilet tank mechanism and used to control water flow to the bowl. When the water level is sufficiently high within the humidifier 44, the float 56 actuates a mechanical shutoff valve or electrically controlled solenoid valve (not shown) between the external tank 82 and the humidifier 44. When the water level within the humidifier 44 drops sufficiently, the corresponding drop in the level of the float 56 allows the valve to open, thereby allowing water to flow from the auxiliary tank 82 to the humidifier 44 through the inlet 92 until the water level is again sufficient to shut off the flow. An additional low water level sensor 58 may be included within the humidifier 44 and/or the auxiliary tank 82, to actuate a warning light for service personnel. In the event of an inlet valve which sticks open, an overflow passage 94 and drain extends from the humidifier 44 to the exterior of the machine 10.

Figure 4:
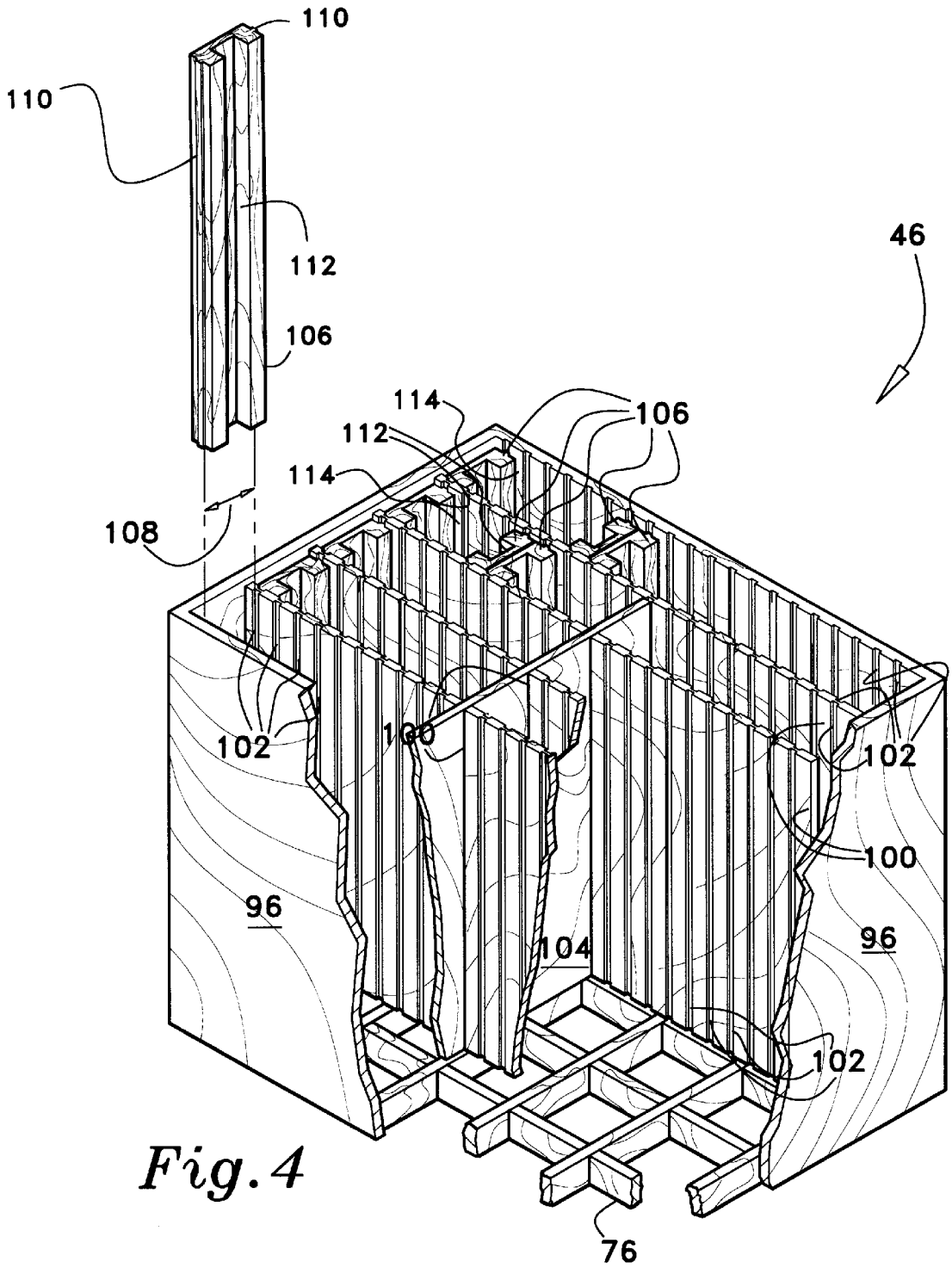
FIG. 4 is a broken away perspective view of the humidor storage area of the machine, showing its construction and the removable dividers therein for different sizes of cigars.
Figure 5:
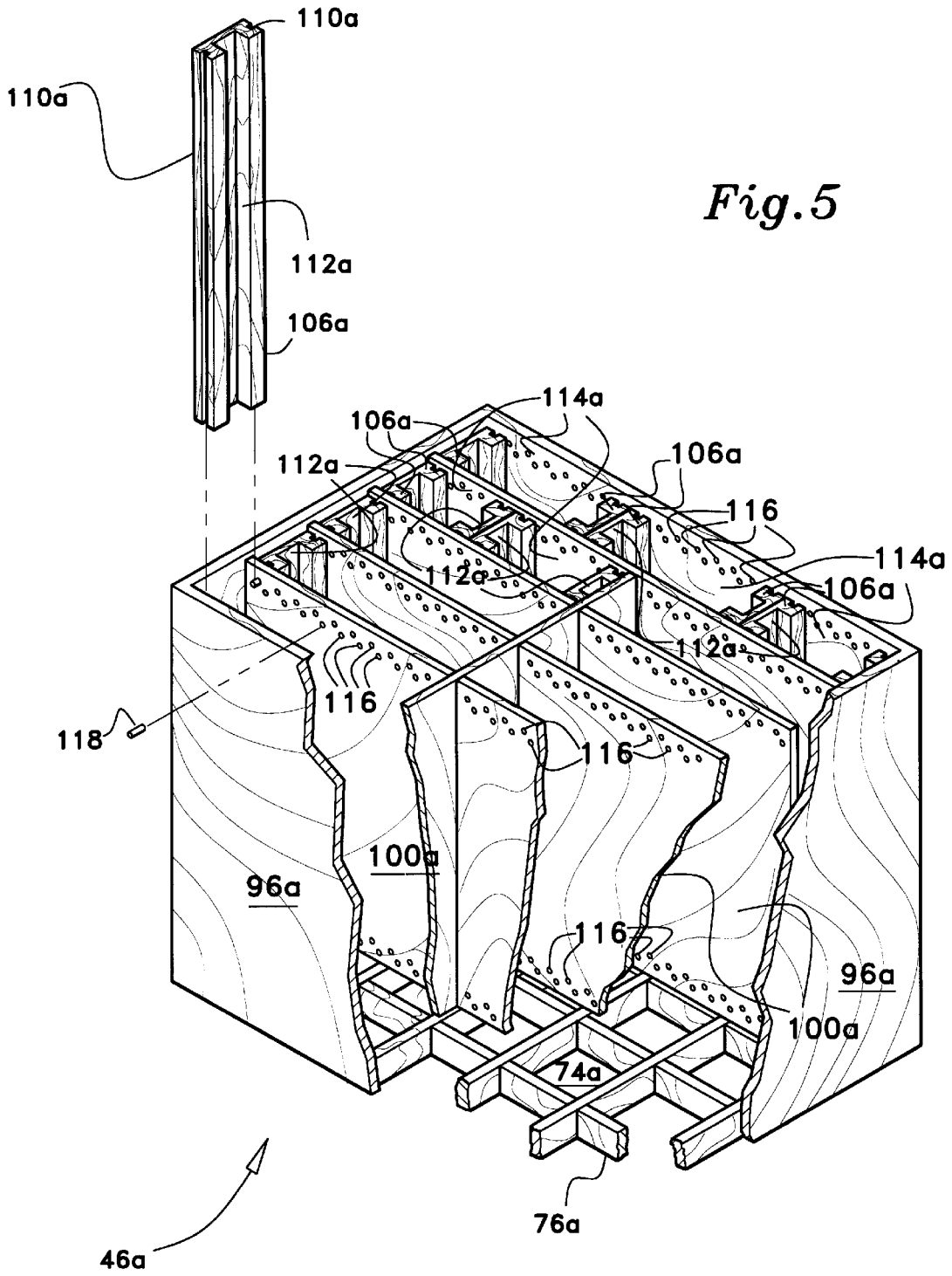
FIG. 5 is a broken away perspective view of an alternative divider retention means.

FIGS. 4 and 5 disclose alternate embodiments of the cigar or article storage cabinet 46 disposed within the lower portion 26 of the internal volume 22 of the housing 12, immediately above the humidifier 44. The exterior of the cabinet 46, comprising the top or lid 72 (not shown in FIGS. 4 and 5, but shown in FIGS. 2 and 3) and the sides 96, is preferably formed of a fine wood, as is the case 50 of the humidifier 44 and the humidifier drawer 48. Spanish cedar has been found to be an excellent material for the storage of fine tobacco, but other woods may be used as desired.

The internal components described below, as well as the wooden grid 76, are also preferably formed of such a wood material. The use of wood assists in the maintenance of a constant humidity within the cabinet 46, by absorbing and releasing moisture from its porous structure according to the humidity within the cabinet 46. The wood also helps to prevent large temperature fluctuations, by means of its insulating properties. Other materials may be used as desired, but wood, and more particularly Spanish cedar, is the preferred material for the construction of at least the humidor portion 42 of the present machine 10. The use of wood also provides an elegant and luxurious appearance for the exterior of the humidor portion 42 of the machine 10, with portions of the front and the top of the humidor 42 being visible to customers through the windows 98 in the front door panel 20.

The cabinet 46 of FIG. 4 includes a series of spaced apart and parallel partitions 100 disposed internally thereacross, with each of the partitions 100 including a plurality of spaced apart, parallel vertical slots 102 formed therein. The opposite internal sides of the cabinet 46 also include corresponding slots 102. Further supplementary partitions 104 may also be inserted within the cabinet 46, as desired, for additional versatility in the arrangement within the cabinet 46. A second series of adjustably positionable and removably installable channel members 106 is provided, with each channel member 106 having a major width 108 substantially equal to the spacing (also designated as reference numeral 108) between any two adjacent ones of the partitions 100.

Each of the channel members 106 also includes a first and an opposite second slot engaging key 110 formed along the opposite edges thereof. This permits the channel members 106 to be inserted between adjacent ones of the slotted partitions 100, with the keys 110 on opposite sides of the channel members 106 engaging facing slots 102 in the adjacent facing partitions 100. These channel members 106 may thus be adjusted to space and position the facing channel member faces 112 to define a plurality of vertically disposed cigar (or other elongate article) storage bins or silos 114 to accommodate different lengths of cigars (or other elongate articles) therebetween, as required to hold and store different types and brands of cigars therein.

The above described partition 100 and channel member 106 configuration is preferred, as the only removable components are the relatively large channel members 106, assuming the partitions 100 are permanently affixed in place within the cabinet 46. However, alternative means of adjustably securing channel members within the partitions of such a cabinet may be used as desired. One such means is shown in FIG. 5, and described below.

In FIG. 5, a cabinet 46*a* is configured similarly to the cabinet 46 shown in detail in FIG. 4 and generally in FIGS. 2 and 3, having an open bottom 74*a*, sides 96*a*, and a normally closed, openable lid (removed for clarity in FIG. 5). An open, wood grid 76*a* may be provided across the open bottom 74*a* of the cabinet 46*a*, to support cigars or other elongate articles stored therein, as well as to provide support for the channel members described below.

However, it will be noted that rather than providing the partitions and interior side walls of the cabinet 46*a* with vertical channels, as in the cabinet 46 of FIG. 4, each of the spaced, parallel partitions 100*a* and opposite interior side walls includes a plurality of peg holes 116 formed therein. Each of the channel members 106*a* includes a first and an opposite second slot 110*a* formed along the opposite lateral edges thereof, with the channel members 106*a* otherwise being essentially identical to the channel members 106 described above and shown in FIG. 4.

The channel members 106*a* are held between adjacent facing partitions 100*a* (or interior side walls of opposite sides 96*a*) of the cabinet 46*a*, by inserting a series of pegs 118 as desired within various of the peg holes 116, then inserting channel members 106*a* so their opposite lateral slots 110*a* engage facing pegs 118 extending from opposite facing partitions 100*a*. Preferably, at least four pegs 118 comprising two facing upper pegs and two facing lower pegs, are used to secure each channel member 106*a* in the cabinet 46*a* of FIG. 5. The channel members 106*a* are easily rearranged by removing them from the cabinet 46*a* and removing and replacing pegs 118 into different peg holes 116, to define cigar storage silos 114*a* between facing channel member faces 112*a*.

Figure 6:
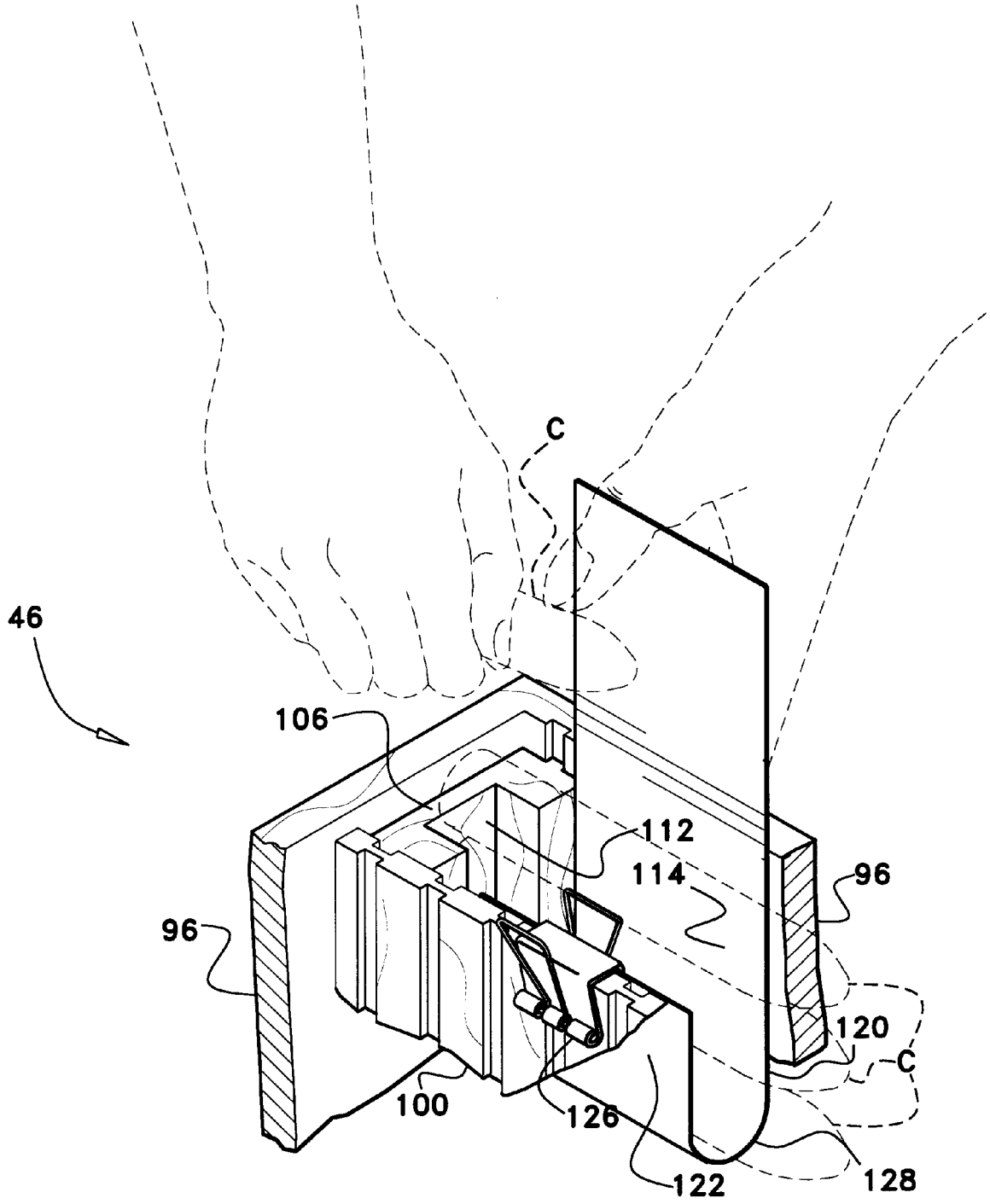
FIG. 6 is a perspective view showing the means used for loading cigars into the bins of the humidor storage area.

FIG. 6 discloses a means of loading cigars C into the silos or bins of the cabinets described above, e. g., the cabinet 46 of FIG. 4 described above. The faces 112 of facing channel members 106 serve to capture the ends of the cigars C therebetween, to hold the cigars C in a vertical stack in each silo or bin 114.

Loading the cigars C in the narrow silos or compartments 114 is easily accomplished by means of an elongate flexible loading band 120 (fabric or paper, etc.) having a capture end 122, an opposite free end 124, and a length slightly longer than twice the depth of the silo or bin 114. The capture end 122 is temporarily attached (e. g., by a clip 126) to one of the partition walls 100 within the cabinet 46, with the intermediate portion 128 of the band 120 being dropped into the adjacent silo compartment 114 and the free end 124 extending upwardly along the opposite wall of the silo compartment 114, so the band 120 generally forms a "U" shape extending downwardly into the silo compartment 114.

At this point, cigars C are placed within the U shape of the band 120, with the free end 124 being lowered gradually toward the interior of the silo compartment 114 to place the bottom of the U formed in the band 120, increasingly lower within the silo bin 114. Additional cigars C are placed atop one another and within the facing channel member faces 112 (one of which is shown in FIG. 6), until the lowermost cigar within the U portion of the band 120 reaches the bottom of the silo or bin compartment 114. The captured end 122 of the loading band 120 may then be detached from the partition 100 to which it was temporarily secured, and the band 120 pulled from the silo compartment 114. The process is repeated for each silo bin 114 in the cabinet 46 (or 46*a*). Removing cigars, if required, may be easily accomplished by means of conventional tongs (not shown) or other appropriate elongate tool or instrument.

Preferably, the only external supply required by the present machine 10 is a power supply from a conventional 115 volt (nominal) ac electrical power supply. Preferably, all water used in the humidifier portion 44 of the present machine is contained therein, either within the humidifier 44 itself, or in an auxiliary tank, such as the auxiliary tank 82 shown in FIG. 2. This is due to the preferred use of distilled water in the humidifier 44, rather than tap water with its impurities, in order to avoid contaminating the humidifier 44 and other areas within the humidor 42.

Figure 7:
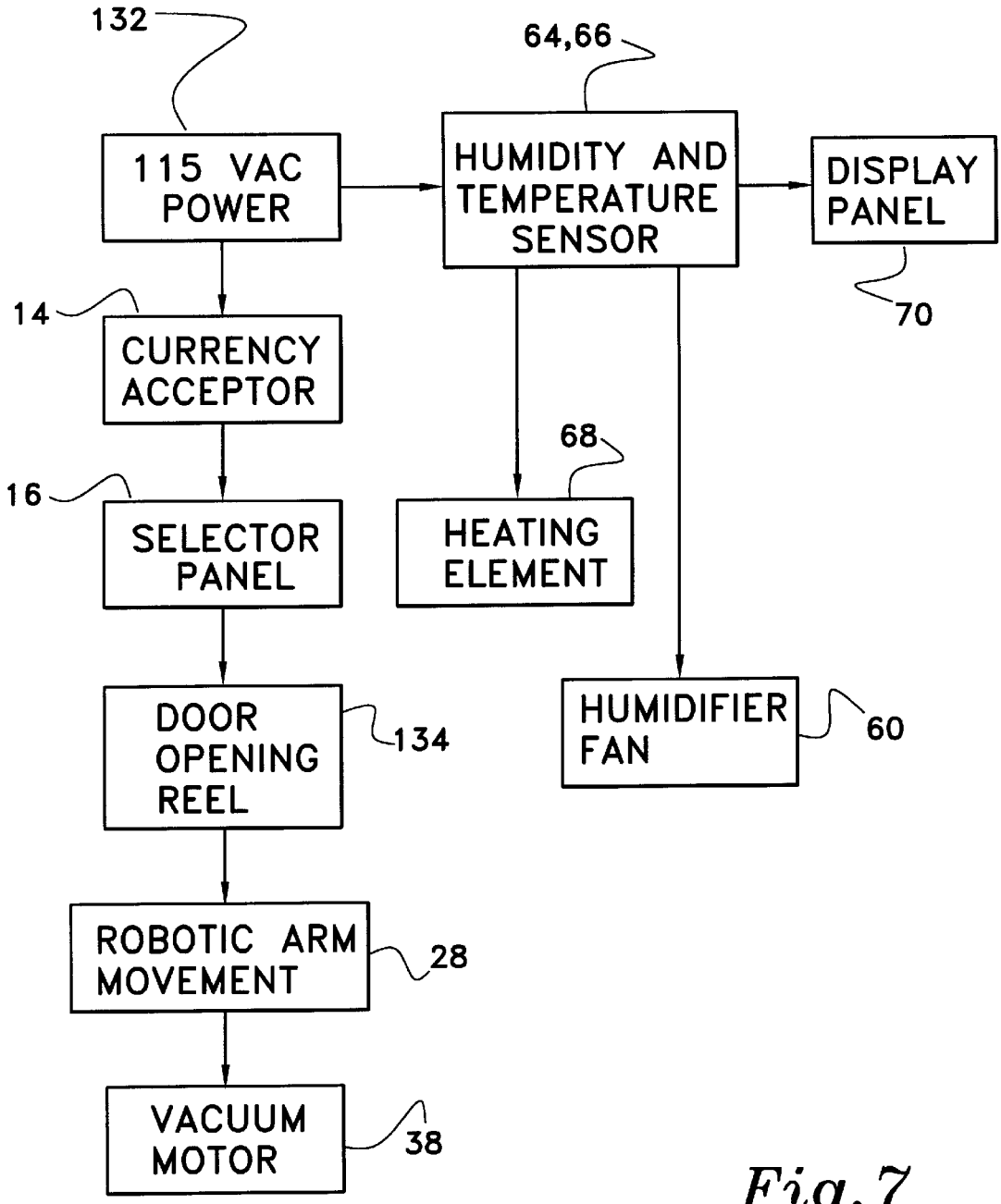
FIG. 7 is a block diagram of the general electrical systems of the present cigar vending machine.

Once the machine 10 has been installed in the desired location, an electrical cord 130 may be plugged into a suitable electrical power source (not shown), with the cord 130 providing power to an electrical junction box 132 within the base of the machine, as shown in FIG. 2 and schematically in FIG. 7. This 115 volt ac power may be modified, using conventional methods well known in the electronic field, to step up or step down voltage, convert to direct current, etc., as required to operate the various systems shown schematically in FIG. 7.

The various electrically operated components of the machine 10, e. g., the currency acceptor 14, cigar selection panel 16, robotic dispensing system or arm movement 28, humidity and temperature sensors 64 and 66, etc., may then be calibrated and adjusted as desired, if this has not been done previously prior to installation of the machine 10. At this point, the machine should be essentially ready for use.

The present cigar vending machine 10 operates basically as depicted in the block diagram of FIG. 7. Once the machine 10 has been installed, the power supply 132 distributes power to the humidity and temperature sensors (hygrometer and thermostat) 64 and 66, and their temperature and humidity display panel readout 70, at all times, in order to maintain the desired, preselected temperature and humidity range within the humidor 42. The humidifier fan motor 60 (and/or heating element 68) are automatically actuated by the hygrometer and thermostat 64 and 66 as required, to maintain the preselected temperature and humidity range, generally around seventy degrees Fahrenheit and seventy percent relative humidity at that temperature.

The currency acceptance panel 14 and cigar selector panel 16 are of course also receiving constant electrical power at all times. When a customer makes a purchase from the present machine, appropriate currency (or a credit card) is inserted into the appropriate slot(s) of the currency device 14, which may be adjusted to read and accept denominations as large as one hundred dollars, and to make change accordingly; it is anticipated that some high quality cigars which may be provided by the present machine may approach twenty dollars in cost, so the provision for large denominations is appropriate. Once the appropriate currency or funds have been provided to the currency acceptance device 14, the customer may make a selection using the selector panel 16, with the different brands and types of cigars stored within the humidor 42 being indicated by an appropriate internal or external display.

When the selection has been made, the internal circuitry within the machine 10 first causes the humidor lid 72 to be raised to a position as shown in broken lines in FIG. 2, by means of a door or lid opening reel and motor 134 (also shown in the base of the machine 10 in FIG. 2) and door or lid lifting cable 136 (shown in FIG. 2). The cable 136 extends upwardly from the reel 134 to a pulley 138 disposed in the upper rear of the machine 10, thence downwardly and forwardly to connect to the forward edge of the lid or door 72 of the cigar storage container or cabinet 46.

Once the lid 72 has been raised, the robotic cigar dispensing arm system 28 is activated, with the movable track 32 being positioned fore and aft within the upper part 24 of the machine 10, to position the pickup arm 34 along the appropriate row of silos, bins, or compartments 114 (or 114*a*) within the cigar storage cabinet 46 (or 46*a*). The arm 34 is then moved along the track 32 to position the arm 34 over the specific silo or compartment 114 or 114*a* containing the desired cigar C.

At this point, the telescoping arm 34 is lowered until the lowermost tip 36 is in contact with the uppermost cigar C within the silo 114 or 114*a*, and vacuum is applied by means of the suction pump and motor 38 and hose 40, to withdraw the selected cigar C from its silo or compartment 114 or 114*a*, and the lowermost end 36 of the arm 34 is raised by telescoping the arm upwardly, so the lowermost tip 36 and cigar C momentarily secured thereto will clear the upper edge of the cigar storage cabinet 46 or 46*a*.

The movable track 32 is then moved to its forwardmost position of travel, adjacent the front door panel 20 of the machine 10, with the cigar storage cabinet lid or door 72 being lowered to its closed position by the reel and motor 134. When the arm 34 reaches its forwardmost position, the arm 34 may be telescoped downwardly again (if so programmed) as shown in broken lines in FIG. 2, and vacuum is released in the system, allowing a cigar C which was momentarily suspended from the tip 36 of the arm 34 to drop from the tip 36, into the dispensing bin 140 disposed within the front door panel 20 below the forwardmost position of the arm 34. The purchaser may then reach into the bin 140 by means of the movable delivery door panel 18, to retrieve the purchased cigar.

The above described process may be repeated as desired, with programming for the present machine 10 perhaps providing for multiple purchases of the same type, or different types, of cigars with a single monetary transaction. The opening of the upper lid 72 of the humidor 46, or more specifically the cigar storage container or cabinet area 46, and the movement of the robotic cigar dispensing system 28, may be viewed through the transparent panels 98 provided in the front door panel 20 of the machine 10, to add interest to the transaction for the purchaser. The upper portion 24 of the interior volume 22 of the housing 12 will be seen to be substantially open, in order to accommodate the movement of the dispensing system 28. Hence, advertising means for cigars or articles contained within the machine 10, and/or other messages, may be provided within the upper portion of the machine as desired.

In summary, the present cigar or article vending machine 10 provides a most useful service to those persons who enjoy a fine cigar at various times. Cigar smoking is still much appreciated by many people, and the rise of cigar smoking rooms in restaurants and bars to accommodate such smokers is an indication of the popularity of cigars with many smokers. However, it can still be difficult for cigar smokers to find fine cigars at locations other than specialized tobacco shops.

The present machine 10 responds to this need. The present cigar vending machine 10 may be installed in or adjacent to specialized cigar smoking areas, or at any point which may be frequented by those who appreciate a good cigar at different times of the day or evening when an open tobacco shop or cigar seller may not be available. The humidor portion of the present machine is unique, in that it is capable of maintaining the freshness of cigars stored therein for long periods of time, in effect providing a "tobacco store" selling fine cigars at any hour of the day or night, for those who desire such an article.

It is to be understood that the present invention is not limited to the sole embodiments described above, but encompasses any and all embodiments within the scope of the following claims.

We claim:

1. A cigar vending machine, comprising:

a housing having an accessible interior including a lower portion and a front door panel for lockably securing access to said interior;

automated currency acceptance means;

cigar selection means;

cigar delivery means;

a cigar humidor apparatus disposed within said lower portion, said humidor apparatus including automated humidifying means for maintaining a preselected level of humidity within said humidor apparatus and a normally closed cigar storage container disposed therein, said cigar storage container including a selectively openable, normally closed top, an open bottom, and an internal volume communicating with said humidifying means through said open bottom of said container;

an open grate disposed across said open bottom of said cigar storage container, said grate being constructed of wood; and automated cigar dispensing means disposed within said housing for selectively acquiring a cigar from said cigar storage container and delivering the selected cigar to said cigar delivery means.

2. The cigar vending machine according to claim 1, including automated heating means disposed within said humidor apparatus, for maintaining at least a minimum temperature therein.

3. The cigar vending machine according to claim 1, wherein said automated cigar dispensing means comprises a first and an opposite and parallel second fixed track disposed in said housing, with a movable track extending between said first and said second track and orthogonally disposed thereto, with a telescoping arm depending from said movable track, with said telescoping arm including a vacuum actuated lowermost tip for selectively applying a vacuum to a cigar for lifting and dispensing the cigar to said cigar delivery means of said front door panel.

4. The cigar vending machine according to claim 1, including a large, supplemental water tank communicating with said humidifying means, for supplying additional water to said automated humidifying means.

5. The cigar vending machine according to claim 4, wherein said housing includes a rear wall with said supplemental water tank being secured externally thereto.

6. The cigar vending machine according to claim 1, including automated water level control means for said automated humidifying means.

7. The cigar vending machine according to claim 1, wherein said humidor apparatus is constructed of wood.

8. The cigar vending machine according to claim 1, including a plurality of parallel, vertical partitions disposed within said cigar storage container, and a plurality of adjustably positionable vertical channel members each removably installable between any adjacent two of said plurality of parallel partitions to define a plurality of vertically disposed cigar storage silos for storing a plurality of different sizes, types, and brands of cigars therein.

9. A cigar vending machine, including:

a housing;

a cigar humidor apparatus disposed within said housing;

a cigar storage container disposed within said humidor apparatus, said cigar storage container including a plurality of parallel partitions disposed therein; and, a plurality of adjustably positionable channel members each removably installable between any adjacent two of said plurality of parallel partitions to define a plurality of cigar storage silos for the storage of different sizes, types, and brands of cigars therein, wherein said partitions each include a plurality of vertically disposed slots formed therein, and said channel members each include a first and an opposite second slot engaging key formed therealong for removably installing each of said channel members between said any adjacent two of said plurality of parallel partitions as desired, with each said key of said channel members engaging one of said slots of each of said any adjacent two of said plurality of parallel partitions.

10. The cigar vending machine according to claim 9, wherein at least said cigar storage container, said partitions, and said channel members are each formed of wood.

11. A cigar vending machine, including:

a housing;

a cigar humidor apparatus disposed within said housing;

a cigar storage container disposed within said humidor apparatus, said cigar storage container including a plurality of parallel partitions disposed therein; and, a plurality of adjustable positionable channel members each removably installable between any adjacent two of said plurality of parallel partitions to define a plurality of cigar storage silos for the storage of different sizes, types, and brands of cigars therein, wherein said partitions each include a plurality of peg holes therein, a plurality of pegs removably installed within said holes, and wherein said channel members each include a first and an opposite second slot for removably installing each of said channel members between any adjacent two of said plurality of parallel partitions as desired by engaging at least two of said pegs installed within each of said any adjacent two of said plurality of parallel partitions.

12. The cigar vending machine according to claim 11, wherein at least said cigar storage container, said partitions, and said channel members are each formed of wood.

13. An article vending machine, comprising:

a housing having an accessible interior including a lower portion and a front door panel for lockably securing access to said interior;

automated currency acceptance means;

article selection means;

article delivery means;

an article humidor apparatus disposed within said lower portion, said humidor apparatus including automated humidifying means for maintaining a preselected level of humidity within said humidor apparatus and a normally closed article storage container disposed therein, said article storage container including a selectively openable, normally closed top, an open bottom, and an internal volume communicating with said humidifying means through said open bottom of said container; and automated article dispensing means disposed within said housing for selectively acquiring an article from said article storage container and delivering the selected article to said article delivery means, wherein said automated article dispensing means comprises a first and an opposite and parallel second fixed track disposed in said housing, with a movable track extending between said first and said second track and orthogonally disposed thereto, with a telescoping arm depending from said movable track, with said telescoping arm including a vacuum actuated lowermost tip for selectively applying a vacuum to an article for lifting and dispensing the article to said article delivery means.

14. The article vending machine according to claim 13, including automated heating means disposed within said humidor apparatus, for maintaining at least a minimum temperature therein.

15. The article vending machine according to claim 13, including a large, supplemental water tank communicating with said humidifying means, for supplying additional water to said automated humidifying means.

16. The article vending machine according to claim 15, wherein said housing includes a rear wall with said supplemental water tank being secured externally thereto.

17. The article vending machine according to claim 13, including automated water level control means for said automated humidifying means.

18. The article vending machine according to claim 13, wherein said humidor apparatus is constructed of wood.

* * * * *